United States Patent [19]

Wang

[11] Patent Number: 4,839,132

[45] Date of Patent: Jun. 13, 1989

[54] PROCESS FOR THE PREPARATION OF LARGE DIAMETER ORIENTED MONOFILAMENTS

[75] Inventor: Teh-Chuan Wang, Parkersburg, W. Va.

[73] Assignee: E. I. Du Pont De Nemours and Company, Wilmington, Del.

[21] Appl. No.: 18,385

[22] Filed: Feb. 25, 1987

[51] Int. Cl.[4] ..... D01F 8/04

[52] U.S. Cl. ..... 264/134; 264/174; 264/210.8; 264/211.15

[58] Field of Search ..... 264/134, 136, 171, 184, 264/210.7, 210.8, 211.14, 211.15, DIG. 26, 174; 428/364, 397, 399

[56] References Cited

U.S. PATENT DOCUMENTS

| | | | |
|---|---|---|---|
| 2,071,250 | 2/1937 | Carothers | 528/272 |
| 2,904,846 | 9/1959 | Smith | 264/174 |
| 3,275,730 | 9/1966 | Feild | 264/174 |
| 3,630,824 | 12/1971 | Rohlig | 428/398 |
| 3,651,014 | 3/1972 | Witsiepe | 528/274 |
| 3,706,111 | 12/1972 | Autin et al. | 15/159 A |
| 3,763,109 | 10/1973 | Witsiepe | 528/274 |
| 4,279,053 | 7/1981 | Payne et al. | 428/398 |
| 4,297,413 | 10/1981 | Sasaki et al. | 264/174 |
| 4,483,970 | 11/1984 | Huntjens et al. | 528/84 |
| 4,584,240 | 4/1986 | Herbert et al. | 428/373 |
| 4,584,353 | 4/1986 | Kobayashi et al. | 525/411 |
| 4,610,925 | 9/1986 | Bond | 428/368 |

FOREIGN PATENT DOCUMENTS

| | | |
|---|---|---|
| 60-185816 | 9/1985 | Japan . |
| 1574220 | 9/1980 | United Kingdom . |

*Primary Examiner*—Hubert Lorin

[57] ABSTRACT

Oriented polymeric monofilaments having a diameter of at least about 60 mils and excellent uniformity in roundness, are prepared in which a core of semi-crystalline linear condensation polymer is melt extruded, quenched to a substantially void-free condition, coated with additional polymer to increase the diameters by about from 10 to 100 mils, quenched to a substantially void-free condition, and oriented by drawing about 3.5 times its original length within the orientation temperature range of the polymer.

7 Claims, No Drawings

PROCESS FOR THE PREPARATION OF LARGE DIAMETER ORIENTED MONOFILAMENTS

BACKGROUND OF THE INVENTION

Since the discovery of oriented linear condensation polymers, as described by Carothers in U.S. Pat. No. 2,071 250, oriented polymeric monofilaments have been used in a wide variety of applications. Carothers himself suggested a number of uses, including artificial hair bristles, threads, filaments, yarns, strips, films, bands and the like. Many of these uses have, in fact, found their way into commercial products, such as components of textile yarns, brush bristles and fishing line. However, it has previously been impossible to prepare oriented polymeric monofilaments having a large diameter, that is, greater than about 50 mils or about 1.27 mm.

The difficulty in preparing such large diameter monofilaments lies in the cooling of such materials after melt extrusion. The nature of such polymers is such that a density differential is created within an extruded structure upon cooling from the plastic to the solid state. Quenching of the filament initially solidifies the outer surface, with a rearrangement of the structure to accommodate the shrinking of the outer surface as it solidifies, at which point the center is still in a molten state. As the center solidifies, it also shrinks, leaving voids in the structure. While this effect is not substantial in small monofilaments, with increasing diameters of monofilament, this density differential from exterior to interior creates voids which either make polymer orientation impossible or result in oriented products with tensile properties that severely restrict end uses. Moreover, large diameter polymeric monofilaments are typically irregular in cross-sectional configuration, being characterized by an ovality that is unacceptable in many applications.

Previous attempts to prepare large diameter monofilaments have included the extrusion of a hollow filament, as described in U.S. Pat. No. 3,630,824. While the possibility of preparing large diameter structures is suggested in that patent, similar difficulties are realized with increasing wall thickness of the hollow filament. Other solutions that are less than completely satisfactory include the use of a polymer having an exceptionally low rate of crystallization, so that the change in density is so gradual that the expected void formation is not realized.

The previous inability to prepare large diameter monofilaments of semi-crystalline, linear polymers has resulted in the use of other shapes, such as flat tapes, when the desirable properties of a polymer were needed combined with tensile requirements that exceeded those that could be obtained with monofilaments. However, a need remains for large diameter monofilaments, particularly in applications where available space does not permit the use of a wide tape.

SUMMARY OF THE INVENTION

The present invention provides a large diameter, round, oriented monfilament and a process for its preparation.

Specifically, the instant invention provides a monofilament prepared from at least one semi-crystalline linear polymer and having a diameter of at least about 60 mils, the monofilament being oriented at least about 3.5 times in the longitudinal direction, having a variation in ovality of less than about 5%, and having at least 2 substantially concentric layers.

The instant invention further provides a process for the preparation of oriented monofilaments, which process comprises (a) melt extruding a core of semi-crystalline linear polymer, (b) quenching the core to solidify the polymer in a substantially void-free condition;

(c) coating the core with additional molten semi-crystalline linear polymer in a round configuration in an amount sufficient to increase the diameter of the core by about from 10 to 100 mils, (d) quenching the resulting structure to solidify it in a substantially void-free condition, and (e) orienting the structure by drawing at least about 3.5 times its original length within the orientation temperature range of the polymer.

DETAILED DESCRIPTION OF THE INVENTION

The oriented monofilaments of the present invention are characterized by a diameter of at least about 60 mils. For some applications, diameters of greater that 80 mils are preferred, and monofilaments having a diameter of at least about 100 mils are particularly preferred. Monofilaments of up to about 250 mils or higher can be prepared according to the invention. Greater diameters are difficult to produce by normal orientation techniques.

The monofilaments are further characterized by a variation in ovality of less than about 5%, and preferably less than about 2%. The term ovality is used in its usual sense, that is, the variation in the diameter around the circumference of the monofilament. Accordingly, the variation between the greatest and least diameter at any point around the circumferential cross-section of the present monofilaments is less than about 5%.

The monofilaments, to obtain desirable tensile properties, are oriented by drawing about from 3.5 to 7 times their original length within the orientation temperature range of the polymer. In order to carry out such orientation, the monofilaments must be substantially free of voids, outside of an internal cavity resulting from a hollow core or multiple longitudinal cavities resulting from special extrusion techniques. Specifically, the void content in the filament walls is less than about 1% of the cross-sectional area of the walls.

The monofilaments can be prepared from a wide variety of semi-crystalline linear polymers, including, for example, copolyether esters, copolyester esters, polyamides, and polyesters. Segmented copolyether esters have been found to provide particularly good performance characteristics, and are accordingly preferred.

Representative copolyether esters which can be used in the present invention include those described in Witsiepe, U.S. Pat. Nos. 3,763,109 and 3,651,014, both of which are hereby incorporated by reference.

Representative polyamides which can be used in the present invention include polycaprolactam (nylon 6), polyhexamethylene adipamide (nylon 6,6) polyundecanoamide (nylon 11), polydodecanoamide (nylon 12), poly(hexamethylene dodecanoamide) (nylon 612), poly(hexamethylene sebacamide) (nylon 610), and polyamide copolymers.

Representative polyesters which can be used in the present invention include polyethylene terephthalate, polybutylene terephthalate, and blends of each of these with each other and other polymers such as the copolyether esters noted above.

Representative polyester esters which can be used in the present invention include those described in detail in U.S. Pat. Nos. 4,483,970 and 4,584,353, both of which are hereby incorporated by reference.

The core and the subsequently applied layer or layers can be the same or different. In general, for best tensile properties, the same polymer is used for both the core and outer layers. In the event that different polymers are used in the core and outer layers, the polymers should be selected to provide compatible orientation characteristics. For example, particularly satisfactory combinations of polymers include polyamide and polyester, copolyether ester and polyester, and copolyether ester and polyamide.

The oriented monofilaments of the present invention can be prepared by (a) melt extruding a core of semi-crystalline linear polymer; (b) quenching the core to solidify the polymer in a substantially void-free condition; (c) coating the core with additional molten polymer in a round configuration and to increase the diameter by about from 10 to 100 mils; (d) quenching the resulting structure to solidify it in a substantially void-free condition; and (e) orienting the structure by drawing at least about 3.5 times its original length at the orientation temperature of the polymer.

The extruded core can be solid or hollow. Hollow cores can be prepared using the techniques shown in U.S. Pat. No. 3,630,824. Multi-locular cores can also be used, prepared, for example, as described in Payne and Rackley, U.S. Pat. Nos. 4,279,053. Both of these patents are hereby incorporated by reference. While the general configuration of the core is most often round or oval, irregular or geometric shapes can be also be used, since the shape of the monofilament after extrusion of the second layer is round. In the event that the core has an irregular configuration, the center, for purposes of the subsequent layer or layers, is considered to be the approximate geometric center of the cross-section. Irregularly shaped cores can provide improved adhesion between the core and the next layer of the filament, particularly when different polymers are used for these two layers.

On extrusion of a round core, a substantial ovality is generally obtained, whether the core is solid or hollow, even though a typical circular extrusion die is used. However, upon applying the second layer, also using a circular extrusion die, this ovality, for reasons not fully understood, is corrected, and the second layer substantially retains its round configuration.

The second layer of polymer should be sufficient to increase the cross-sectional diameter of the monofilament, before orientation, by about from 10 to 100 mils. A diametric increase of less than 10% generally does not provide an appreciable change in the characteristics of the filament, while diametric increases of greater than 100 mils can result in void formation that would interfere with orientation. If greater diameters are required, additional layers can be applied in a similar fashion. Each additional layer of polymer should similarly increase the diameter by about from 10 to 100 mils.

After completion of the extrusion of the polymer layers in the monofilament, it is oriented by drawing about from 3.5 to 7 times its original length within the orientation temperature range of the polymer. While some prior orientation of the core before extrusion of the subsequently applied layer or layers is possible, it is preferred that all layers be oriented together.

The large diameter monofilaments of the present invention are useful in a wide variety of power transmission applications, including, for example, those devices where the applied forces previously required polymeric tape or coated and uncoated steel cable. Particular automotive applications for which the products of the present invention are useful include passive restraint systems, window regulators, and antenna drive systems.

EXAMPLE 1

A void-free monofilament was melt extruded from copolyether ester using an extruder have an orifice of 0.185 inch. The monofilament was quenched in water and wound up on a spool. The monofilament exhibited by a substantial variation in ovality. The major diameter of the monofilament was 168 mils and the minor diameter was 150 mils.

The solidified monofilament was then passed through an extrusion coating apparatus in which a second layer of copolyetherester was added to give the monofilament a substantially round cross-section and increase its diameter by about 78 mils. The monofilament was quenched in water as before, after which the largest and smallest diameters were 228 mils in the major dimension and 227 mils in the minor dimension.

The monofilament was then oriented by drawing 4.5X with heating to within the orientation temperature range by a radiant heater maintained at 550° C.

After orientation, the monofilament exhibited a major diameter of 117 mils, a minor diameter of 115 mils, and a cross-sectional area of 0.01062 square inches. The monofilament was evaluated for tensile properties according to standard test procedures, as described, for example, in Curtin and Hansen, U.S. Pat. No. 3,706,111, and found to have the following characteristics:

Tensile Strength: 24,000 psi
Tensile Modulus: 126,000 psi
Elongation: 78%
Breakload: 256 pounds

I claim:

1. A process for the preparation of oriented monofilaments of semi-crystalline linear condensation polymer, which process comprises (a) melt extruding a core of semi-crystalline linear condensation polymer,
(b) quenching the core to solidify the polymer in a substantially void-free condition;
(c) coating the core with additional molten semi-crystalline linear condensation polymer in a round configuration in an amount sufficient to increase the diameter of the core by about from 10 to 100 mils,
(d) quenching the resulting structure to solidify it in a substantially void-free condition, and
(e) orienting the structure by drawing at least about 3.5 times its original length within the orientation temperature range of the polymer to provide an oriented filament having a diameter of at least about 60 mils.

2. A process of claim 1 further comprising repeating steps (c) and (d) to increase the diameter of the monofilament about from 10 to 100 mils with each such repetition.

3. A process of claim 1 wherein the same polymer is used throughout the process.

4. A process of claim 1 wherein the polymer consists essentially of copolyetherester.

5. A process of claim 1 wherein the polymer consists essentially of polyamide.

6. A process of claim 1 wherein the polymer consists essentially of polyester.

7. A process of claim 1 wherein the polymer consists essentially of polyester ester.

* * * * *